US008770696B2

(12) United States Patent
Matsumoto

(10) Patent No.: US 8,770,696 B2
(45) Date of Patent: Jul. 8, 2014

(54) RECORDING MATERIAL FEEDING DEVICE AND RECORDING APPARATUS

(75) Inventor: Tadashi Matsumoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 747 days.

(21) Appl. No.: 12/620,798

(22) Filed: Nov. 18, 2009

(65) Prior Publication Data

US 2010/0128079 A1 May 27, 2010

(30) Foreign Application Priority Data

Nov. 21, 2008 (JP) ..... 2008-297972

(51) Int. Cl.
*B41J 29/38* (2006.01)

(52) U.S. Cl.
USPC ..... 347/16; 162/135

(58) Field of Classification Search
USPC ..... 347/16; 162/135
See application file for complete search history.

(56) References Cited

U.S. PATENT DOCUMENTS

| | | | | |
|---|---|---|---|---|
| 5,709,382 | A * | 1/1998 | Shima | 271/209 |
| 5,751,299 | A * | 5/1998 | Denton et al. | 347/2 |
| 6,011,948 | A * | 1/2000 | Amano et al. | 399/395 |
| 6,098,875 | A * | 8/2000 | Cheng et al. | 232/15 |
| 6,382,762 | B1 * | 5/2002 | Therien | 347/19 |
| 6,457,888 | B1 | 10/2002 | Matsumoto | 400/625 |
| 6,712,463 | B2 | 3/2004 | Matsumoto | 347/104 |
| 7,681,882 | B2 * | 3/2010 | Yu et al. | 271/243 |
| 7,731,175 | B2 * | 6/2010 | Kang | 271/110 |
| 2003/0020773 | A1 * | 1/2003 | Schantz et al. | 347/14 |
| 2004/0045686 | A1 * | 3/2004 | Nisogi et al. | 162/135 |
| 2005/0270355 | A1 * | 12/2005 | Sootome et al. | 347/104 |
| 2006/0140654 | A1 * | 6/2006 | Takiguchi et al. | 399/45 |
| 2006/0182477 | A1 * | 8/2006 | Takiguchi et al. | 399/396 |
| 2010/0150632 | A1 * | 6/2010 | Matsumoto et al. | 399/395 |

FOREIGN PATENT DOCUMENTS

| | | | |
|---|---|---|---|
| JP | 2003-252485 | | 9/2003 |
| JP | 2004-051340 | | 2/2004 |
| JP | 2005-067803 | A | 3/2005 |
| JP | 2005067803 | A * | 3/2005 |

OTHER PUBLICATIONS

Japanese Office Action issued in counterpart Japanese Application No. 2008-297972 dated Jan. 9, 2013.

* cited by examiner

*Primary Examiner* — Peter Radkowski
(74) *Attorney, Agent, or Firm* — Fitzpatrick, Cella, Harper & Scinto

(57) ABSTRACT

A recording material feeding device for feeding a recording material on which an image is to be formed by a droplet of ink ejected from recording means includes a feeding roller pair, including rotatable rollers, for feeding the recording material; feeding means for feeding the recording material to the feeding roller pair; and a control portion for controlling the feeding means so that the recording material is fed to form a curl in a state in which a leading edge of the recording material contacts a nip of the feeding roller pair being at rest. The control portion controls the feeding means so that a curling degree of the recording material which has been subjected to recording on a first surface of the recording material is larger than that of the recording material which has not been subjected to recording.

19 Claims, 4 Drawing Sheets

RECORDING MATERIAL FEEDING DEVICE AND RECORDING APPARATUS

FIELD OF THE INVENTION AND RELATED ART

The present invention relates to a feeding device for feeding (conveying) a recording material (recording medium) on which an image is to be formed by a recording means and relates to a recording apparatus including the feeding device.

As one of recording apparatuses, a printer of an ink jet type (hereinafter referred to as an ink jet recording apparatus) has been known.

A general ink jet recording apparatus effects recording on the recording material by ejecting ink from a recording head. The ink jet recording apparatus has the advantages of easy downsizing of the recording head, high-speed recording of a high-definition image, and low running cost. Further, the ink jet recording head is of a non-impact type, thus also having the advantages of less noise, easy recording of a color image by using multi-color inks, and the like.

Particularly, it is possible to effect recording at a higher speed by using a full-like type ink jet recording apparatus using a line type recording material including a number of nozzles arranged in a widthwise direction of the recording material.

In some conventional ink jet recording apparatuses, in order to align a front end of the image, to be formed by the plurality of recording heads for ejecting inks of different colors, with a leading edge of the recording material, a means for correcting oblique movement of the recording material is provided.

Hereinbelow, the convention ink jet recording apparatus including the oblique movement correcting means will be briefly described. Such an ink jet recording apparatus includes a registration roller pair, including rotatable rollers, provided in a feeding path of the recording material, pre-registration rollers provided upstream of the registration roller pair in the feeding path with respect to a feeding (conveying) direction of the recording material. The pre-registration rollers feeding the recording material stops after the leading edge of the recording material is detected by a registration sensor and then a certain time elapses. As a result, between the registration roller pair being at rest and the pre-registration rollers, a curl of the recording material is formed. Further, the leading edge of the recording material is abutted against a nip of the registration roller pair, so that the oblique movement of the recording material is corrected. The registration roller pair starts rotation simultaneously with start of printing to feed the recording material, so that each recording head effects printing with predetermined timing.

Thus, in the case where the oblique movement of the recording material is corrected by forming the curl by the abutment of the leading edge of the recording material against the nip of the registration roller pair being at rest, there arisen a problem such that the recording material having low stiffness causes yielding and therefore sufficient oblique movement correction cannot be made. In a constitution described in Japanese Laid-Open Patent Application (JP-A) 2004-051340, control such that an ambient temperature or an ambient humidity is detected and a degree of curl (curling degree) is decreased in an environment of a high temperature or a high humidity in which the stiffness of the recording material is lowered is effected.

Further, with respect to thick paper such as post card, it is difficult to keep a state in which the leading edge of the thick paper is abutted against the nip of the registration roller pair being at rest, so that a technique of decreasing the curling degree in the case of the thick paper has also been known (JP-A 2003-252485).

Therefore, it is desirable that the oblique movement is corrected by forming the curl to the extent such that even a thin recording material does not cause the yielding and even a thick recording material can be kept in the state in which the leading edge thereof is abutted against the nip of the registration roller pair.

However, when printing on both sides of the recording material is performed, the following problem occurred. That is, in the case of performing the both-side printing, after the printing is performed on a first surface (front surface) of the recording material, the recording material is turned upside down and then is fed again to perform the printing on a second surface (back surface). During the printing (recording) on the second surface, cellulose constituting the recording material is expanded due to the printing on the first surface, so that an elasticity coefficient of the recording material is considerably lowered and at the same time the curl occurs. With a small curling degree, it is difficult to stably about the leading edge of the recording material against the nip of the registration roller pair during the recording (printing) on the second surface.

SUMMARY OF THE INVENTION

The present invention has been accomplished in view of the above-described problems.

A principal object of the present invention is to provide a recording material feeding device capable of forming a curl by stably abutting a leading edge of a recording material against a nip of a feeding roller pair even when the recording material has been subjected to recording on its first surface.

According to an aspect of the present invention, there is provided a recording material feeding device for feeding a recording material on which an image is to be formed by a droplet of ink ejected from recording means, the recording material feeding device comprising:

a feeding roller pair, including rotatable rollers, for feeding the recording material;

feeding means for feeding the recording material to the feeding roller pair; and a control portion for controlling the feeding means so that the recording material is fed to form a curl in a state in which a leading edge of the recording material contacts a nip of the feeding roller pair being at rest;

wherein the control portion controls the feeding means so that a curling degree of the recording material which has been subjected to recording on a first surface of the recording material is larger than that of the recording material which has not been subjected to recording.

According to the present invention, even with respect to the recording material having been subjected to the recording on its first surface, the curl can be stably formed by bringing the leading edge of the recording material into contact with the nip of the feeding roller pair.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
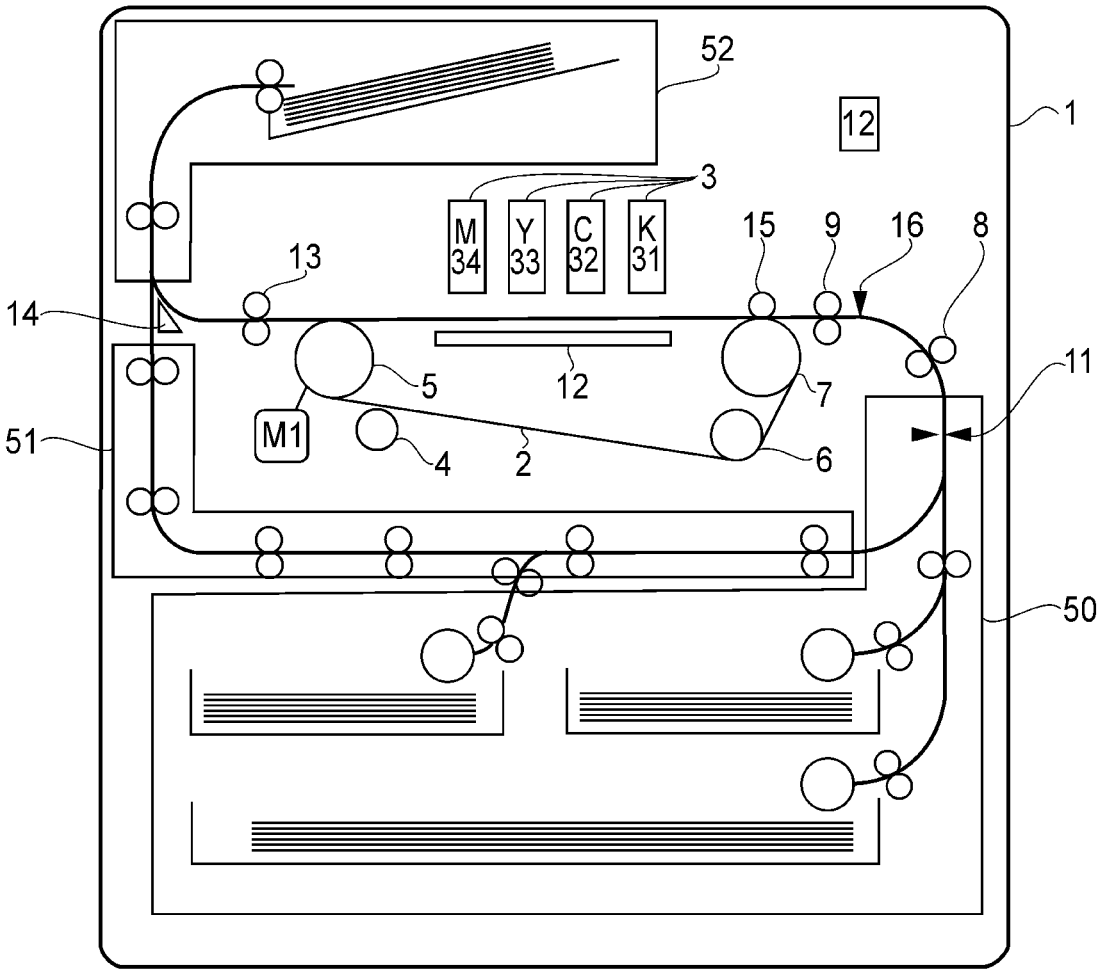
FIG. 1 is a schematic sectional view showing an Embodiment of the recording apparatus according to the present invention.

Hereinbelow, Embodiments of the present invention will be described with reference to the drawings. FIG. 1 is a schematic sectional view of an ink jet recording apparatus including a recording material feeding device. The ink jet recording apparatus forms an image on a recording material by depositing a minute droplet of ink, ejected from a recording means, on the recording material.

An ink jet recording apparatus 1 shown in FIG. 1 includes, as the recording means, four recording heads 31 to 34 for ejecting inks of black (K), cyan (C), yellow (Y), and magenta (M). These recording heads 31 to 34 eject ink droplets of associated ones of the inks by being driven by a control pair described later. In the following description, the four recording heads 31 to 34 are also collectively referred to as a "recording head 3".

A sheet-like recording material ST (hereinafter referred to as a "sheet ST") is fed from a feeding pair 50 toward first rollers (registration roller pair 9) by second rollers (pre-registration rollers 8). Each of the recording heads 31 to 34 is provided with a plurality of nozzles arranged along a direction perpendicular to a feeding (conveying) direction of the sheet ST.

During image formation (printing), the sheet ST is fed by the registration roller pair 9 and passes below the recording heads 3 while being electrostatically attracted and moved by a feeding belt 2. The feeding belt 2 is an elongated circuit member and is stretched and rotationally driven by a driving roller 5 and supporting rollers 6 and 7, thus feeding (conveying) the sheet ST.

A cleaning mechanism 4 removes the ink deposited on the feeding belt 2.

The sheet ST fed by the feeding belt 2 is discharged by a discharging means (not shown) located in front of the driving roller 5 to be separated from the feeding belt 2 and then is fed by separation feeding rollers 13 located downstream of the driving roller 5 with respect to the feeding direction. Thereafter, when the printing is completed, the sheet ST is fed to a sheet discharge portion 52 including a sheet discharge tray by a selector lever 14. On the other hand, in the case of effecting the both-side printing, the sheet ST is once fed to the sheet discharge portion 52 and then is turned back to be guided into a both-side feeding portion 51 by selecting the selector lever 14, so that the sheet ST is fed by the both-side feeding portion 51. The sheet ST fed by the both-side feeding portion 51 again enters the sheet feeding path in front of a paper thickness detecting sensor 11 in the sheet feeding portion 50, thus being fed again to the printing portion. Here, the both-side printing means that an image is formed on one surface (first surface) of the sheet ST and thereafter an image is formed on the other surface (second surface opposite from the first surface) of the sheet ST, so that the images is formed on both of the first surface and the second surface.

Figure 2:
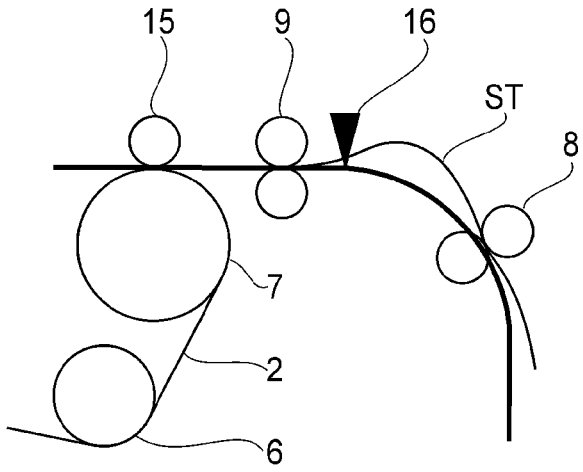
FIG. 2 is a partly enlarged view showing pre-registration rollers 8, a registration roller pair, including rotatable rollers, 9, and the neighborhood thereof, which are shown in FIG. 1.

FIG. 2 is a partly enlarged view of the pre-registration rollers 8 and the registration roller pair 8, which are the feeding means and are shown in FIG. 1, and the neighborhood of the rollers. As shown in FIG. 2, in a state in which a leading edge of the sheet ST fed by the pre-registration rollers 8 contacts the nip of the registration roller pair 9, when the sheet ST is further fed by the pre-registration rollers 8, the sheet ST causes a curl with a curling degree. The curling degree is a feeding amount (distance) of the sheet ST by the pre-registration rollers 8 after the leading edge of the sheet ST contacts the nip of the registration roller pair 9 being at rest. After the leading edge of the sheet ST is detected by a registration sensor, the pre-registration roller 8 feeding the sheet ST is stopped after a lapse of a certain time, the curl of the sheet ST is formed between the pre-registration rollers 8 and the registration roller pair 9. Further, the leading edge of the sheet ST is abutted against the nip of the registration roller pair 9, so that the oblique movement of the sheet ST is corrected. That is, the pre-registration rollers 8 and the registration roller pair constitute a curl forming means for forming the curl with respect to the sheet ST in advance of the start of the image formation on the sheet ST. Further, the registration roller pair 9 also functions as a registration adjusting means for adjusting the oblique movement correction of the sheet ST.

Figure 3:
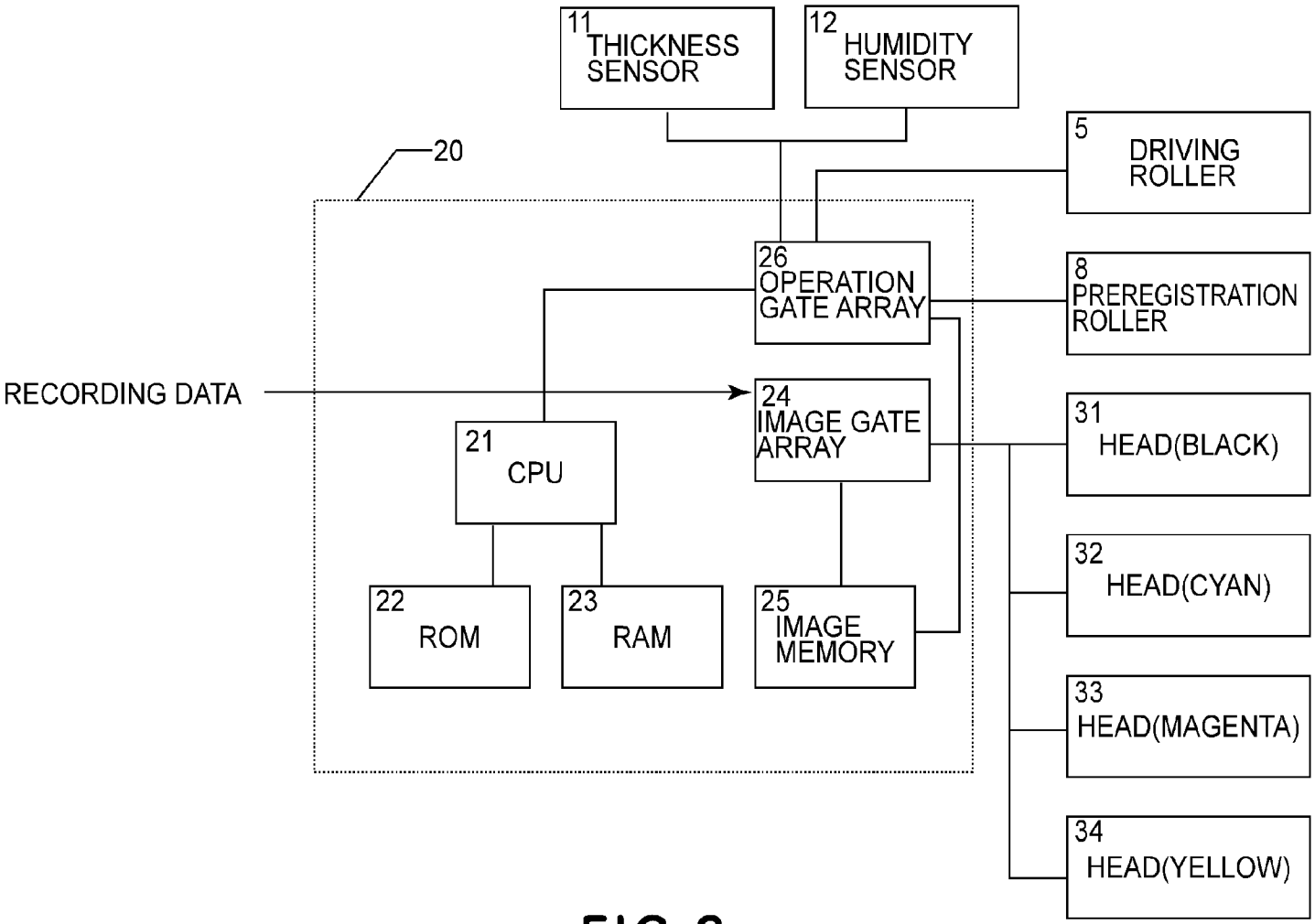
FIG. 3 is a block diagram showing a constitution of the recording apparatus shown in FIG. 1.

FIG. 3 is a block diagram showing a constitution of the ink jet recording apparatus 1. A control portion 20 includes a CPU 21, an ROM 22 for storing a program, an RAM 23 for storing working data necessary for control, an image control gate array 24, and an operation control gate array 26. The operation control gate array 26 controls outputs of driving control signals for the driving roller 5, the pre-registration rollers 8, and the like and controls various input signals of the paper thickness sensor 11, the humidity sensor 12, and the like. The image control gate array 24 effects output control of an image signal, a pulse width table value, and the like to the recording heads 3. A reference numeral 25 represents an image memory. The image control gate array 24 temporarily stores recording data received externally. In the RAM 23, a data table showing a relationship among the type of paper, an amount of shot of ink, and the curling degree is stored in advance. During the both-side printing, the ink shot amount is calculated from the image data stored in the image memory 25 and is stored in the RAM 23. When the sheet ST after completion of the printing on one surface (first surface) is fed again to the printing portion, the operation control gate array 26 obtains the curling degree necessary to adjust the leading edge registration performed for the printing on the other surface (second surface). Specifically, the necessary curling degree is obtained by using the data table based on paper type information obtained from the paper thickness sensor 11 and based on the ink shot data stored during the printing on the first surface. Then, the pre-registration rollers 8 are controlled so as to provide the obtained curling degree.

Figure 4:
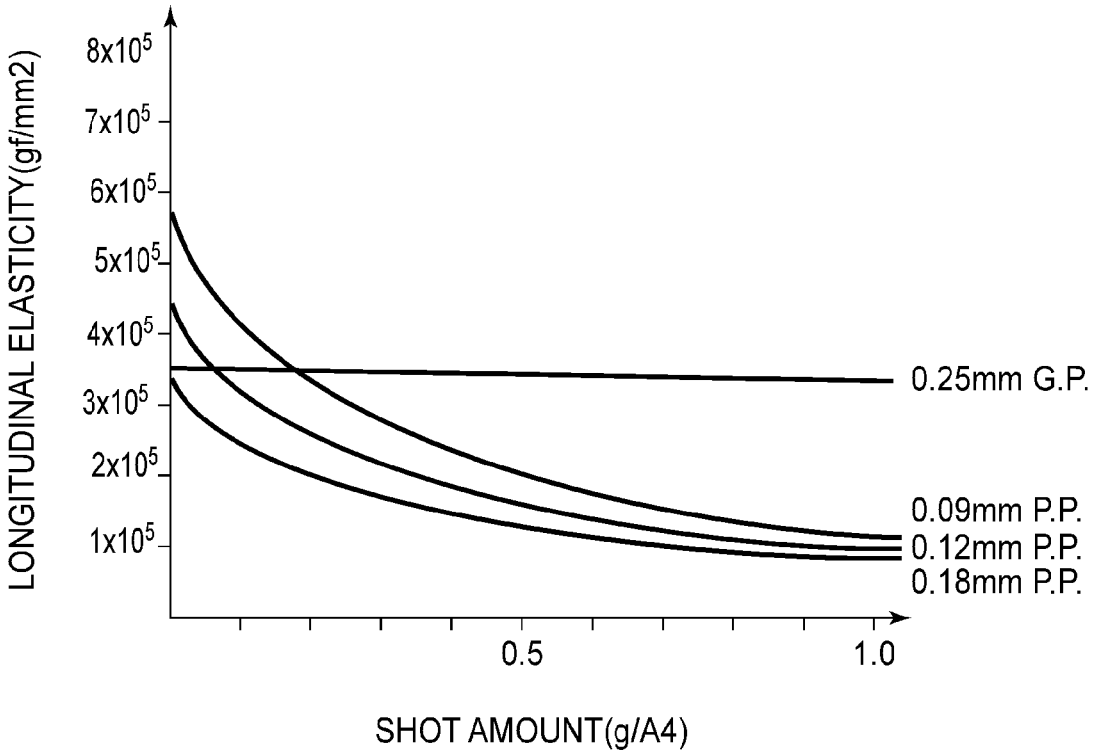
FIG. 4 is a graph showing a result of an experiment conducted for investigating longitudinal elasticity (elastic modulus) of a recording material immediately after printing is performed by an recording apparatus of an ink jet type.

FIG. 4 is a graph showing a result of an experiment for investigating longitudinal elasticity immediately after the printing is performed by the recording apparatus of the ink jet type. An abscissa represents an amount of shot of ink deposited in an area corresponding to A4 size (g/A4) when a uniform image (solid image) is formed on the entire surface of the recording material (paper). The reason why the shot amount per unit area is that a change in longitudinal elasticity of the recording material is expansion of pulp constituting the recording material.

In the case of the inks used in this experiment, the amount of shot of ink for obtaining a maximum density for a single color is about 0.5 (g/A4). Further, in the case of the color image, the amount of shot of ink for obtaining a maximum density for plural colors is about 1.0 (g/A4).

An ordinate represents the longitudinal elasticity (gf/$mm^2$). As a result of measurement performed immediately after the printing on the recording material, the change in longitudinal elasticity of plain paper with the paper thickness of 0.09 mm is largest and is decreased with an increased paper thickness. Further, with respect to glossy paper subjected to surface processing, there is no change in longitudinal elasticity even when the shot amount is changed. In the case of the plain paper, it is understood that the value of the longitudinal elasticity converges to a certain value.

Figure 5:
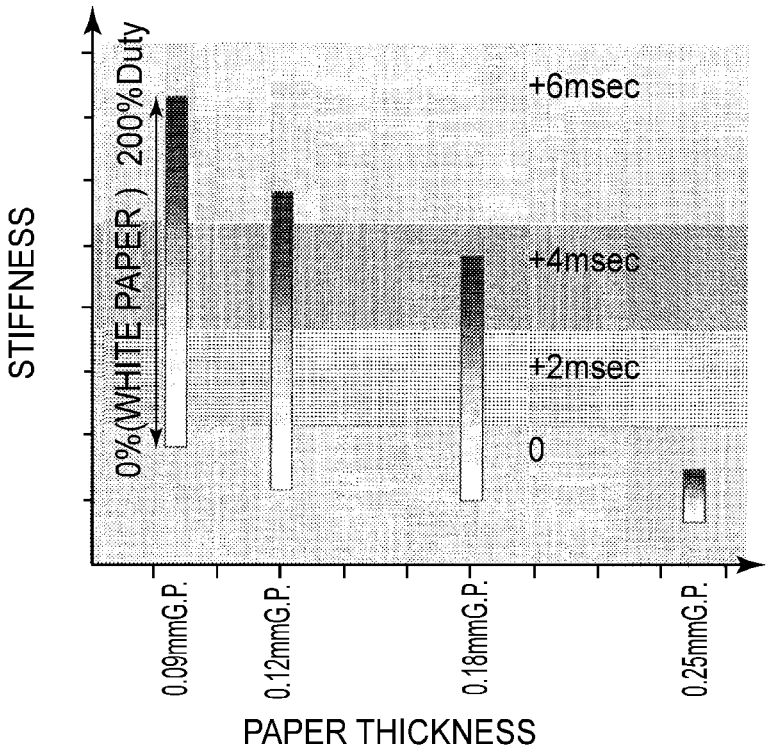
FIG. 5 is a schematic view showing a result of study on a time required for forming a curl necessary to adjust leading edge registration during both-side printing, on the basis of that during one-side printing.

FIG. 5 is a graph showing a result of study on a time required for forming the curl necessary to adjust the leading edge registration during the both-side printing, on the basis of the result of the above-described experiment. Incidentally, the curling degree of the curl formed before the first surface printing may also be constant irrespective of the thickness of the paper. In the case where the curling degree is constant irrespective of the paper thickness, the curling degree is small to the extent that the curl can be formed, irrespective of the paper thickness. The curling degree may also be changed depending on the paper thickness, humidity, or the like.

In FIG. 5, an ordinate represents stiffness of the recording material (paper) and employs a parameter which is linearly changed similarly as in the case of the longitudinal elasticity. An abscissa represents the paper thickness. Specifically, the ink shot amount at each paper thickness is represented by a bar chart. From the graph of FIG. 5, it is understood that it is possible to realize stable leading edge registration adjustment by setting the curling degree of the curl formed in front of the registration roller pair 9 (FIG. 2) during the both-side printing on the basis of the paper thickness of the recording material and the ink shot amount. In the case where the both-size printing is performed on the plain paper with the paper thickness of 0.09 mm at 200% duty (corresponding to the maximum shot amount for color), a driving time of the pre-registration rollers 8 is 6.0 msec longer than that in the case of the one-side printing. When the driving time of the pre-registration rollers 8 is increased by 6.0 msec, a feeding amount is increased by 2.0 mm.

Figure 6:
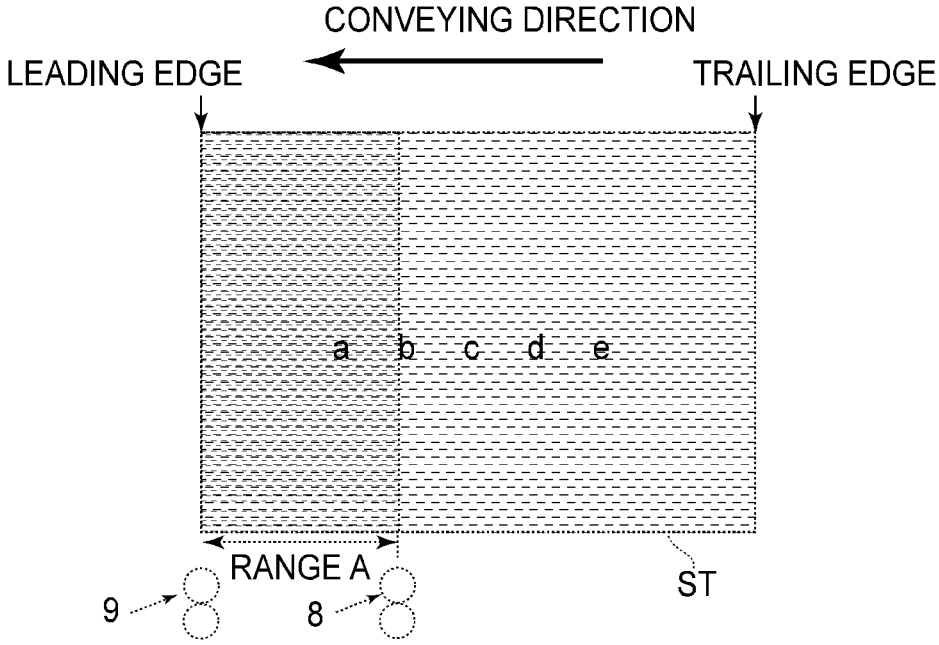
FIG. 6 is a schematic view showing an area, of one surface of a recording material, associated with adjustment of a curling degree depending on a change in longitudinal elasticity by shot of ink.

With reference to FIG. 6, the case where two types of backgrounds and an image are printed on the sheet ST will be described. The sheet ST is subjected to the printing while being conveyed in the direction indicated by an arrow in FIG. 6, so that a left end is the leading edge and a right end is trailing edge. When such a sheet ST is fed again for the both-side printing, the curl is formed after the leading edge of the sheet ST abuts against the registration roller pair (FIGS. 2 and 6) to stop the sheet ST and then the sheet ST is further fed (conveyed) in a set amount by the pre-registration rollers 8 (FIGS. 2 and 6). For that reason, an area associated with the adjustment of the curling degree depending on the change in longitudinal elasticity by the above-described shot of ink is a predetermined area of the sheet ST (a range A in FIG. 6). In other words, an area other than the range A is an area which is not associated with the leading edge registration adjustment. In the experiment, a distance between the registration roller pair 9 and the pre-registration rollers 8 was 130 mm. In other words, a length of one side of the range A parallel to the conveying direction of the sheet ST corresponds to the distance between the registration roller pair 9 and the pre-registration rollers 8. That is, the range A of the sheet ST is a portion located between the registration roller pair 9 and the pre-registration rollers 8 at the instant at which the sheet ST contacts the nip of the registration roller pair 9.

Therefore, it is possible to stably adjust the leading edge registration by changing the curling degree depending on the ink shot amount in the range A of the sheet ST.

Incidentally, the recording apparatus 1 in the above-described Embodiment is not provided with the humidity sensor. However, the humidity sensor may also be added as desired, so that the curling degree may also be set based on the humidity in addition to the ink shot amount and the paper type.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 297972/2008 filed Nov. 21, 2008, which is hereby incorporated by reference.

What is claimed is:

1. A recording material feeding device for feeding a recording material on which an image is to be formed by a droplet of ink ejected from recording means, said recording material feeding device comprising:

a feeding roller pair for feeding the recording material;

feeding means for feeding the recording material to said feeding roller pair; and a control portion for controlling said feeding means so that the recording material is fed to form a bend in a state in which a leading edge of the recording material contacts a nip of said feeding roller pair;

wherein, in a first mode said control portion controls said feeding means so that a bending degree of the recording material which has been subjected to recording on a first surface of the recording material is larger than that of the recording material which has not been subjected to recording, and in a second mode said control portion controls said feeding means so that a bending degree of the recording material which has been subjected to recording on a first surface of the recording material is equivalent to that of the recording material which has not been subjected to recording.

2. A device according to claim 1, wherein the bending degree of the recording material which has been subjected to recording on the first surface of the recording material depends on a thickness of the recording material and an amount of the ink droplet ejected for forming the image on the first surface.

3. A device according to claim 1, wherein the bending degree of the recording material which has been subjected to recording on the first surface of the recording material depends on an amount of the ink droplet ejected for image formation in an area of the recording material between the nip and said feeding means when the leading edge of the recording material contacts the nip.

4. A recording apparatus comprising:

a recording material feeding device according to claim 1; and recording means for ejecting a droplet of ink to a recording material fed by said recording material feeding device.

5. An apparatus according to claim 4, further comprising a both side feeding portion for feeding the recording material, which has been subjected to recording on a first surface of the recording material by said recording means, to said feeding means in order to effect recording on the first surface of the recording material and on a second surface opposite from the first surface.

6. An apparatus according to claim 4, wherein said recording means is a recording head including a plurality of nozzles arranged along a direction perpendicular to a feeding direction of the recording material.

7. A printing apparatus comprising:

a print unit configured to print an image on a sheet with an inkjet head; and a control unit configured to perform registration of the sheet by forming a bend with the sheet prior to be printed, wherein, when printing on a first surface and a second surface of the sheet in sequence, the control unit controls such that a first registration time to form the bend prior to printing on the first surface differs from a second registration time to form the bend prior to printing on the second surface, and wherein the second registration time is set in accordance with a longitudinal elasticity of the sheet which has been subjected to printing on a first surface by the print unit.

8. The apparatus according to claim 7, the second registration time is longer than the first registration time, and the bend formed in the second time is larger than the bend formed in the first time.

9. The apparatus according to claim 8, further comprising a first roller unit and a second roller unit to form the bend therebetween.

10. The apparatus according to claim 8, wherein the second registration time is set in accordance with a thickness of the sheet and an amount of the ink ejected on the first surface to print the image, wherein the longitudinal elasticity of the sheet depends on the thickness and the amount.

11. The apparatus according to claim 10, wherein the amount of the ink ejected on a predetermined area having a length that is same as a length between the first roller unit and the second roller is used to set the second registration time.

12. A printing apparatus adapted to perform both side printing including a first side printing and a second side printing, comprising:

a print unit configured to print an image on a sheet with an inkjet head;

a conveying unit having a roller configured to convey the sheet to the print unit: and a control unit configured to control the conveying unit to perform registration of the sheet before printing, by letting a leading end of the sheet contact the roller while the roller temporary stops rotation during a registration time, wherein the control unit sets the registration time at each of the registration for the first side printing and the second side printing, and the registration time for the second side printing is variable in accordance with a longitudinal elasticity of the sheet.

13. The apparatus according to claim 12, wherein the registration time for the second side printing is longer than the registration time for the first side printing, whereby a bend formed in the sheet by the registration for the second side printing is larger than a bend formed in the sheet by the registration for the first side printing.

14. A printing method of performing printing on a sheet, comprising:

performing a first registration of the sheet by letting a leading end of the sheet contact a roller while the roller temporary stops rotation during a first registration time to form a bend of the sheet;

performing a first side printing on a first side of the sheet with an inkjet head after the first registration;

performing a second registration of the sheet by letting a leading end of the sheet contact the roller while the roller temporary stops rotation during a second registration time to form a bend of the sheet; and performing a second side printing on a second side of the sheet which is a back of the first side of the sheet with the inkjet head after the second registration, wherein the second registration time is variable in accordance with a longitudinal elasticity of the sheet.

15. The method according to claim 14, wherein the second registration time is longer than the first registration time, whereby the bend of the sheet formed at the second registration is larger than the bend of the sheet formed at the first registration.

16. A printing apparatus comprising:

a print unit configured to print an image on a sheet with an inkjet head;

a roller configured to convey the sheet;

a control unit configured to form a bend with the sheet prior to be printed by letting a leading end of the sheet contact the roller while the roller temporary stops rotation during a time;

wherein, when printing on a first surface and a second surface of the sheet in sequence, the control unit sets the time to be a first time to form the bend prior to printing on the first surface, and a second time to form the bend prior to printing on the second surface, and wherein in case the sheet is a first type, the first time is different from the second time, and in case the sheet is a second type different from the first type, the first time is equivalent to the second time.

17. The apparatus according to claim 16, wherein in case the sheet has a first type, the second time is longer than the first time.

18. The apparatus according to claim 17, wherein the bend formed in the second time is larger than the bend formed in the first time.

19. The apparatus according to claim 16, wherein a thickness of the sheet having the second type is larger than a thickness of the sheet having the first type.

* * * * *